US005162765A

United States Patent [19]

DiVincenzo et al.

[11] Patent Number: 5,162,765

[45] Date of Patent: Nov. 10, 1992

[54] ADJUSTABLE MAGNETIC TRIPPING DEVICE AND CIRCUIT BREAKER INCLUDING SUCH DEVICE

[75] Inventors: Gregory T. DiVincenzo, Easton; Richard M. Collevechio, Trappe, both of Md.

[73] Assignee: North American Philips Corporation, New York, N.Y.

[21] Appl. No.: 814,972

[22] Filed: Dec. 23, 1991

[51] Int. Cl.[5] ..... H01H 9/00

[52] U.S. Cl. ..... 335/175; 335/172

[58] Field of Search ..... 335/23-25, 335/167-176

[56] References Cited

U.S. PATENT DOCUMENTS 3,886,507 5/1975 Johnston et al. ..... 335/167

*Primary Examiner*—Lincoln Donovan

*Attorney, Agent, or Firm*—David R. Treacy

[57] ABSTRACT

Adjustment of the static position of the armature of a solenoid or relay-type structure is used to adjust the trip level. An armature stop rod extends through an opening in the structure and is bent over to adjust the length of the stop rod between the frams opening an the active part of the armature. A compact structure is achieved by winding the device coil on a plastic bobbin which provides a bearing for the armature at one end, and an extension through which the adjustment portion of the stop rod extends. This permits ready adjustment after assembly, even when the device spring is arranged around the armature inside the bobbin.

5 Claims, 8 Drawing Sheets

FIG. 7
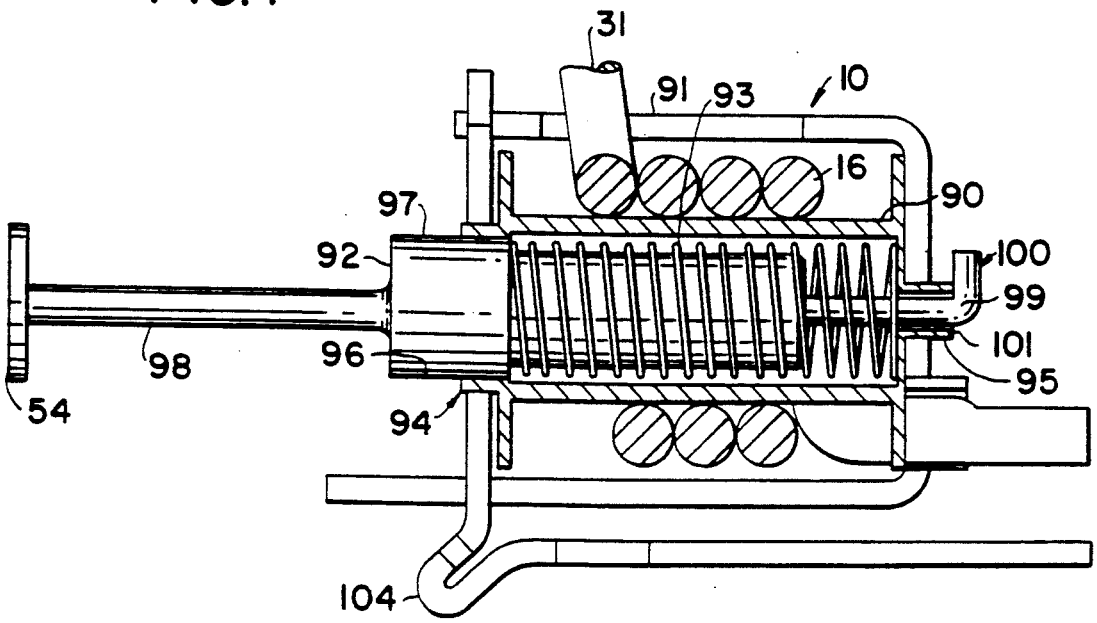
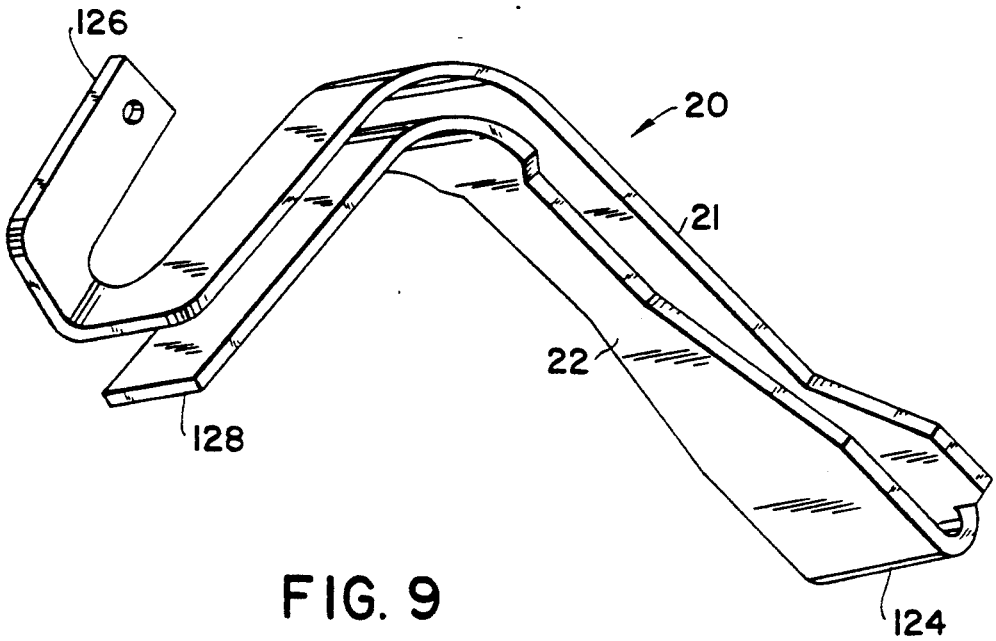
FIG. 9

ADJUSTABLE MAGNETIC TRIPPING DEVICE AND CIRCUIT BREAKER INCLUDING SUCH DEVICE

CROSS-REFERENCE TO RELATED APPLICATIONS

This application is one of three concurrently-filed applications disclosing common subject matter but claiming different inventions. The others are Trip Link Latch and Interpole Link for a Circuit Breaker, by Gregory T. DiVincenzo,John Lucos and Keith A. Singler; and Magnetic Blow-out Circuit Breaker with Booster Loop Arc Runner by Gregory T. DiVincenzo.

BACKGROUND OF THE INVENTION

The invention relates to the field of magnetic actuators, and in particular to magnetic tripping devices which are designed to respond to the magnitude of a voltage or current by operating if this magnitude exceeds a certain value. Rather than being designed to provide maximum force for a given size or electrical power input, actuators of this type have details of magnetic and physical construction selected to maximize the accuracy of tripping level—that is, there should be only a small variation between the current or voltage which may cause tripping, and the highest value for which tripping may not occur.

An especially important use of magnetic tripping devices is to provide fast tripping of an electrical circuit breaker in response to a relatively large overcurrent condition, without tripping due to a brief overcurrent such as a motor starting current. In these circumstances the permissible inrush current may be three or more times the long-term overcurrent limit; but it is desirable that tripping occur rapidly in the event of a larger overload, to avoid damage to equipment obtaining current from the breaker.

One well-known method of adjusting the actuating level (current or voltage) of a relay or solenoid is to adjust the spring forceholding the armature against a stop. To do this, either the remote end of the spring must be held by an adjustment device, or springs must be selected or trimmed. The former method is widely used for relays having a clapper which is attracted toward an electromagnet subassembly, and is usable with solenoids having an exterman spring. However, when it is desirable to minimize size or moving mass, particularly of a solenoid, an internal spring is apt to be the designer's choice. Selecting or trimming springs then requires repeated disassembly and reassembly.

In multi-pole circuit applications, the designer faces a compromise: a solenoid used to release a trip latch will make it easier to trip all poles quickly, and because only a small force is required to actuate the latch, a fast solenoid is easier to achieve in a compact construction. However, if very heavy spring forces are to be avoided, a hammer action is desirable, in which the solenoid directly pulls open a movable contact arm. Such a solenoid is designed to develop very high force when a short circuit current flows through the coil. Making such a solenoid also accurately and economically adjustable has not been possible to date.

SUMMARY OF THE INVENTION

An object of the invention is to permit factory adjustment of the trip level of a magnetic tripping device without requiring extra spring-adjustment screws or brackets, and without requiring selection or trimming of springs.

Another object of the invention is to provide an adjustable solenoid having an internal spring, whose trip level can be adjusted without disassembly.

According to the invention, a magnetic tripping device has an adjustable armature stop rod which is used to define the static position of the armature with respect to the region where a concentrated magnetic field attracts (or repels) the armature. By using the same stop element which exists in all such tripping devices, there is no increase in the parts count.

Preferably, the stop rod has a portion which is arranged coaxially with the armature along its movement direction and is plastically deformable so that bending a portion which engages the device frame allows adjustment of the length between the main part of the armature and the point of engagement with the frame.

In a preferred embodiment, the device is a solenoid having a hollow central zone into which a plunger armature is attracted. An actuating portion extends from the magnetically active main portion of the armature outward from the front of the coil portion of the solenoid. The armature stop rod extends through the zone and out through a rear central opening, and is bent to engage the solenoid structure at an end surface of the opening.

In a further preferred embodiment, the solenoid coil is wound on an insulating bobbin which has a front portion serving as a bearing for the armature, and a rear extension protruding from the magnetic frame. The stop rod adjustment portion passes through the rear extension and is bent over against the end surface of the bobbin extension. This construction permits insulation of the armature from the solenoid frame, while permitting easy adjustment of the static position of the armature, and thus adjustment of the trip level.

BRIEF DESCRIPTION OF THE DRAWING

FIG. 7 is a layout of the magnetic tripping solenoid of FIG. 1, FIG. 9 is a perspective view of the booster loop element at an enlarged scale.

DESCRIPTION OF THE PREFERRED EMBODIMENT

Overall construction and operation

Figure 1:
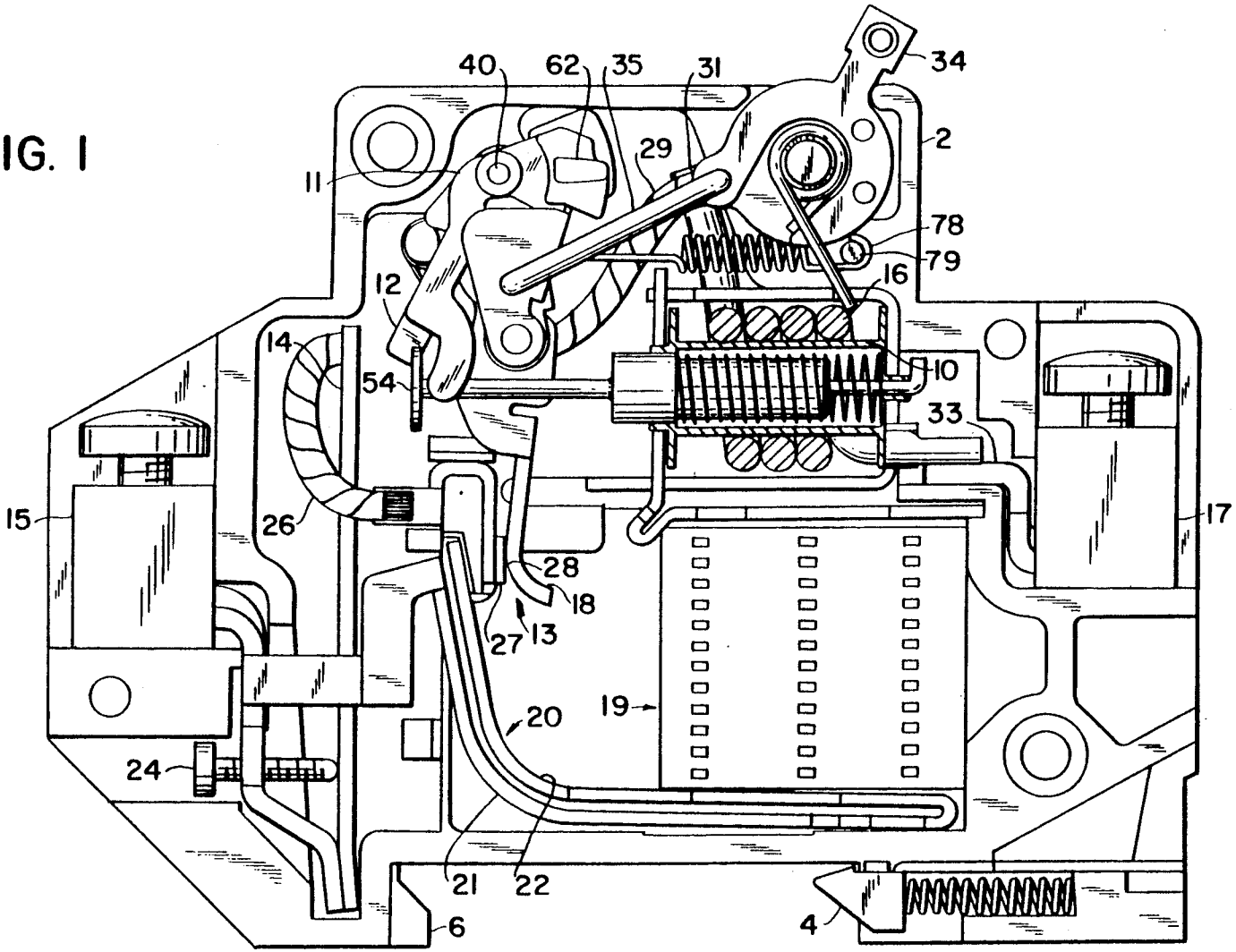
FIG. 1 is a simplified layout of the principal parts of a magnetic blow-out circuit breaker according to the invention.

A multi-pole circuit breaker, one pole of which is shown in FIG. 1, is contained and mounted in an insulating housing 2 having conventional external snap in mounting elements 4 and 6. The breaker includes a magnetic tripping solenoid 10 for tripping a trip link latch and multi-pole link mechanism 11 which incorporates a novel trip link element 12. The trip link 12 is tripped to open a contact set 13 upon sensing a relatively high overload current carried from the line terminal connection 15 through a bi-metal strip or element 14, the contact set 13, and the coil 16 of the solenoid 10, to a load terminal connection 17.

The same contact set is opened as a result of movement of the bi-metal strip 14 if the breaker has been carrying a small overload current for a relatively long period of time.

Upon counterclockwise pivoting of the trip link 12, the other parts of the mechanism 11 release the latch for a movable contact arm 18 which pivots counterclockwise to open the contact set 13. The current flow which is to be interupted will, immediately after contact opening, flow across the gap between the contacts of the set. Magnetic forces cause the arc to be moved toward an arc chute 19. As soon as the arc has been spread and moved (downwards as viewed in FIG. 7) one end of the arc transfers to the arc runner and booster loop 20, current traveling from line terminal connection 15 flows down a booster loop portion 21 and back up the arc runner portion 22 to the spot to which the arc has transferred. Magnetic forces cause the arc to be stretched and move toward the arc chute 19, the arc being so stretched when it enters the chute that it is extinguished.

Other elements shown in FIG. 1 are generally typical of those known in the art. The bi-metal strip 14 has its cold position adjusted by a screw 24 which permits calibration of the long-term current trip setting. Current flowing through the bi-metal strip is carried by a multi-strand flexible wire strap 26 to the fixed contact 27. Current from a movable contact 28 on the contact arm 18 is carried over multi-strand flexible strap 29 to one end 31 of the solenoid coil 16. The other end of the solenoid coil 16 is connected by a relatively rigid conductor 33 to the load terminal connection 17.

A handle 34 connected to a handle link 35 is used to open, close, and reset the movable contact 18 via the mechanism 11.

The contact latching and unlatching mechanism

The mechanism 11 and its parts are shown in FIGS. 2–6. The movable contact arm 18 is pivotably mounted on a latch and contact pivot pin 36 which is fixed in a crank 38 which, in turn, is pivotable mounted on a mechanism pivot pin 40 fixed to the frame 2 of the breaker. The pivot pin 36 also supports a pivotable latch 42 to which the handle link 35 is connected. The functional interconnection of the crank, latch and contact arm will be described below with respect to FIGS. 2–5 which show stages in tripping of the breaker.

Figure 6:
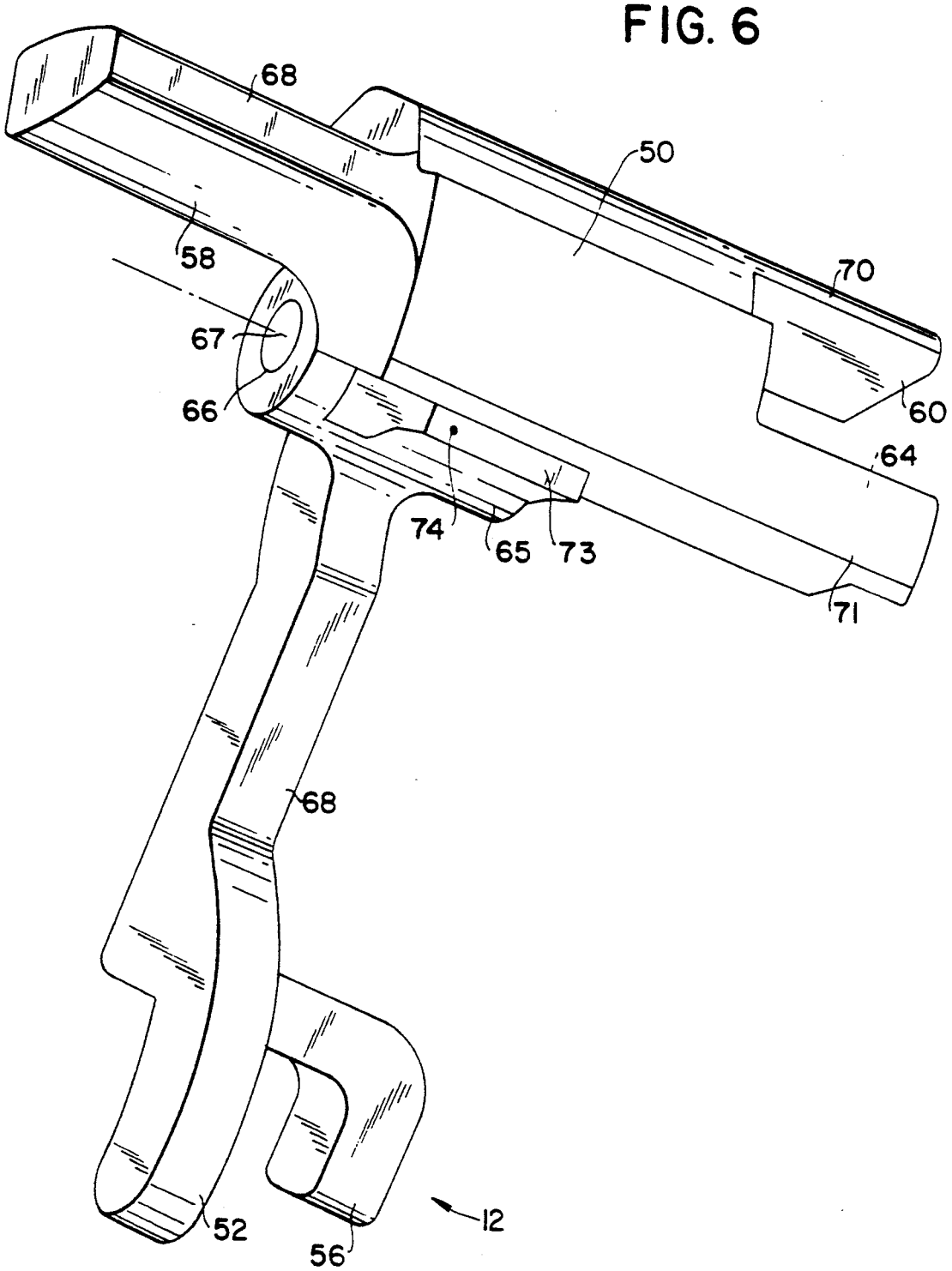
FIG. 6 is an oblique view of the trip link/interpole trip element at an enlarged scale.

The trip link 12, shown in detail in FIG. 6, is the major interconnecting element between the momentary overload magnetic trip solenoid 10, the long-term overload bi-metal strip 14, and latching parts of each of the poles of the breaker. Before describing its structure in detail, we will summarize its functions so that the structural relationships will be more meaningful. The following description treats the link 12 shown as though it is part of the middle pole mechanism of a 3-pole breaker, the three poles and their mechanisms being substantially identical.

The trip link may be operated to unlatch the parts for the movable contact arm 18 of this pole in any of three ways: striking of a finger 52 by an actuating disc 54 of the solenoid 10 of this pole; pushing of a finger 56 by the end of the bi-metal strip 14 of this pole; or contact of one of the inter-pole actuating surfaces 58 and 60 by a trip link (not shown) of an adjacent pole of the same breaker. If this trip link is pivoted as a result of any of those occurrences, after unlatching the movable contact 18 of this pole it will operate either or both of the adjacent poles, in sequence, such that all poles are tripped, via contact of the surface 62 (shown in FIG. 1) or the surface 64 (obscured in FIG. 6) which faces surface 60 with respective corresponding surfaces 58 or 60 of the adjoining pole units.

The trip link 12 is preferably molded as one piece of a reinforced synthetic resin material having excellent insulating properties, such as 15% polyester glass having short fibers. This is the only part extending between adjacent poles, so that such construction increases the high voltage isolation between the breaker pole assemblies. The link 12 has a center hub 65 surrounding a pivot mounting hole 66 which defines a pivot axis 67, for mounting over the mechanism pivot pin 40. A relatively long sensing arm 68 extends generally radially from the hub 65, and terminates in the fingers 52 and 56. These fingers are preferably offset from each other both angularly and axially, so that the actuating disc 54 and the bi-metal element 14 may be arranged to have non-overlapping paths of movement.

An adjoining-pole operating projection 69, on which the surfaces 58 and 62 are formed, extends axially in one direction from the hub, at an average radius distance from the axis 67 much less than the length of the sensing arm 68; and at the opposite end of the hub two operating projections 70 and 71 extend axially, separated by a space substantially wider angularly than the angular width of the projection 69, the facing surfaces 60 and 64 being formed on the respective projections 70 and 71.

A latching surface 73 is formed near the root of the sensing arm 68, the surface 73 being generally circularly cylindrical about the axis 67. For the advantages to be described later with respect to detailed operation, the trip link 12 is proportioned such that its center of gravity 74 falls near the axis 67, generally in line axially with the fingers 52 and 56.

As shown in FIGS. 2–5, the crank 38 and trip link 12 are pivoted, axially adjoining each other, on the mechanism pivot pin 40. A latch and contact pivot pin 36 interconnects the contact arm 18, crank 38 and latch 42, the pin 36 being fixed optionally to one of these elements, and pivotally journalled in the other two. The latch 42 has a latching projection 76 extending radially with respect to the pivot 36, which in the closed contact position shown in FIG. 2 presses against the latching surface 73 of the trip link 12 to form a secondary latch.

Preferably, the latch 42 and the crank 38 are U-shaped metal stampings as viewed from their respective pivots, with the open end of each "U" facing away from the handle 34. The sensing arm 68 of the trip link 12 is aligned so it can pass between the legs of the latch 42, and the contact arm 18 is arranged between the legs of the crank 38. A mechanism spring 78 is stretched between a pin 79 fixed to the housing 2 and an opening 80 in the crank 38 (shown in FIG. 5) to pull the crank in a direction toward the solenoid 10.

Figure 2:
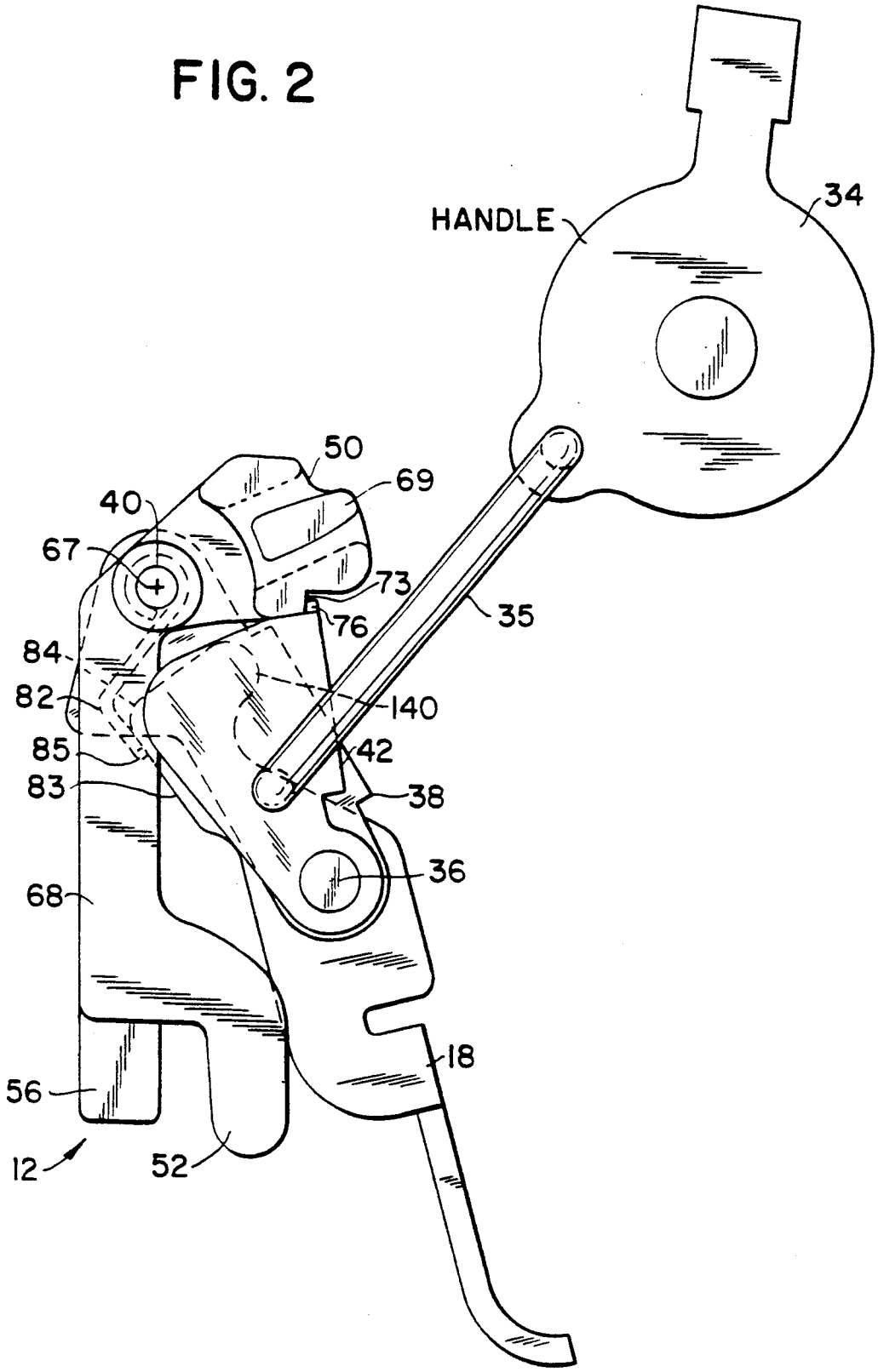
FIG. 2 is a diagrammatic view of the contact and latch mechanism of the breaker of FIG. 1 in the closed position.

As shown in FIG. 2, in the contact closed position an end 85 of a contact pressure spring 82, extending from the mechanism pivot pin 40, bears against a side edge 83 of the contact arm 18, urging the contact arm in a clockwise direction about the pivot pin 36 to provide proper pressure between the movable contact 28 and the fixed contact 27. As will be explained below, in the initially tripped position shown in FIG. 5 the spring 82 bears against an end edge 84 of the contact arm 18, tending to urge the arm 18 counterclockwise so as to hold the contacts open.

A trip link spring (not shown) urges the trip link 12 in a clockwise direction about the pin 40 at all times.

Adjustable solenoid

As shown in FIG. 7, the solenoid 10 is a subassembly having five principal parts: a coil 16, an insulating bobbin 90, a soft magnetic steel frame 91, an armature 92, and a spring 93. The bobbin is hollow, to provide room for the armature 92 and spring 93, and has two coaxial end extensions 94 and 95. The front extension 94 fits within an opening 96 in the frame 91. This opening concentrates the magnetic field in the region within and adjacent to the opening, while the plastic material of the bobbin extension forms a bearing journal for the largest diameter part 97 of the main portion of the armature 92 which extends through the opening 96. The coil 16 and armature 92 can therefore be completely insulated from each other and the solenoid frame 2.

An armature extension 98 extends axially away from the large diameter part 97 to the actuating disc 54. At the other end of the armature main portion a stop rod 99 passes through the extension 95, preferably with a loose fit. An end portion 100 of the stop rod is bent sharply at least obliquely, and preferably about 90° away from the armature and bobbin axis, to bear against the outer end 101 of the extension 95. The compression spring 93 is captured between the largest diameter part 97 of the armature and the rear end of the bobbin adjacent the extension 95.

At least the stop rod portion of the armature is made from a plastically deformable material, so that the bend between the end portion 100 can be formed at a location along the stop rod selected to control the static position of the large diameter portions of the armature with respect to the opening 96 in the frame 2. The length of the stop rod between the bend and the armature main portion therefore determines the magnitude of current required to overcome the force of the spring 93, so that the momentary current trip level can be adjusted accurately after the solenoid has been assembled, without need for selecting and trimming springs.

It is convenient to bend a corner 104 of the solenoid frame 2 outward to form a stop for the movable contact arm 18.

Booster Loop and Arc Runner

Figure 8:
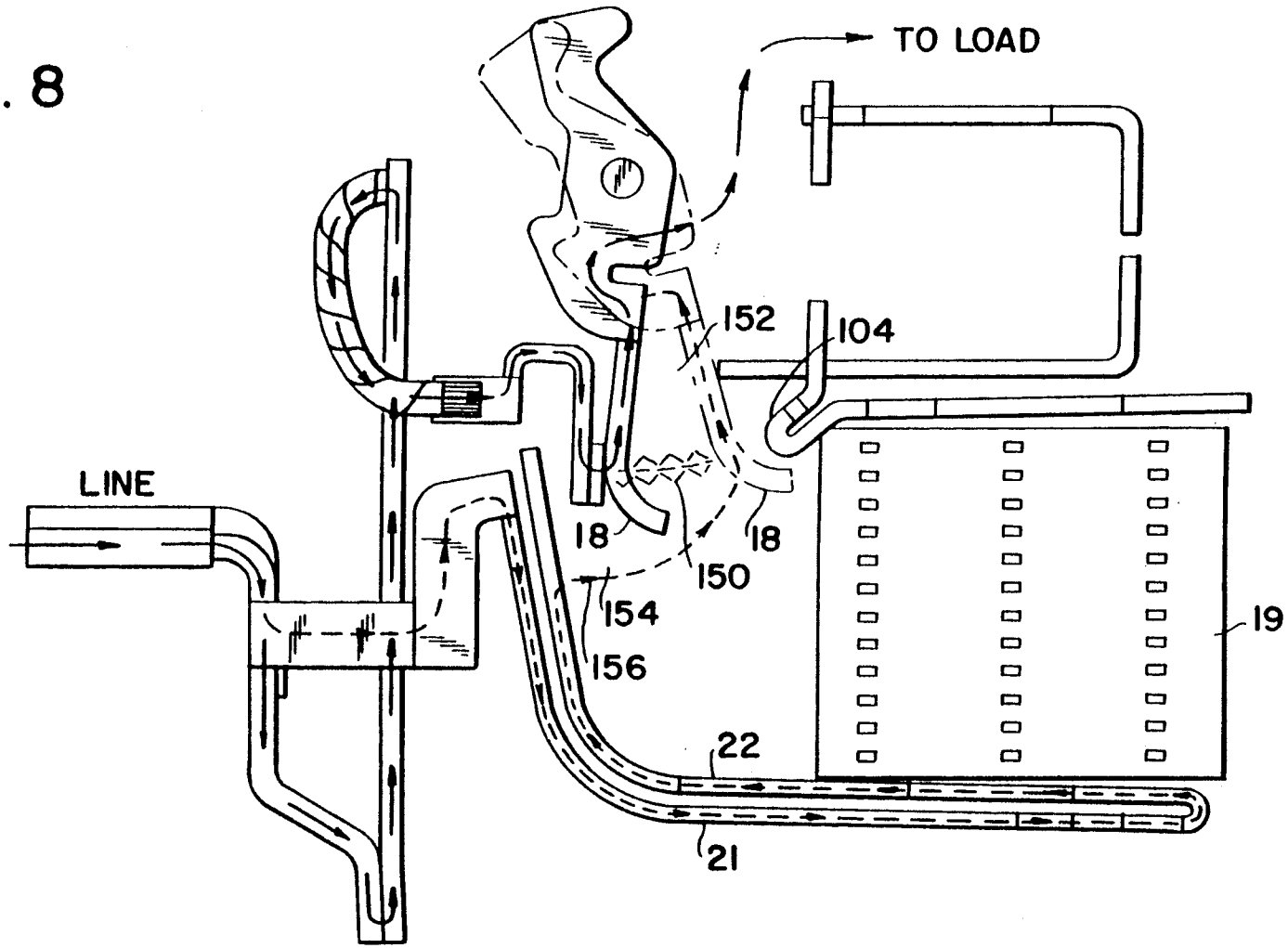
FIG. 8 is diagrammatic view of the booster loop and arc cavity of the embodiment of FIG. 1.

The configuration and current flow patterns of the arc blow-out parts of the breaker are shown in FIG. 8, while the rigid conducting element forming the booster loop and arc runner 20 is shown magnified in FIG. 9.

The rigid booster loop and arc runner 20 is stamped and bent from one piece of hard copper, folded over so that one end 124 fits between the arc chute 19 and the rear wall of the breaker housing 2, the end 124 being adjacent the rear (in the direction of arc blow-out) end of the chute 19. The other end 126 of the booster loop portion 21 is bent for convenience to attach directly to the line terminal connection 15. Except for the bent end 126, the booster loop 21, including the region of it adjacent the end 124, is parallel to the arc runner 22. This not only permits a very compact construction but, as described below, provides a performance advantage because the arc is accelerated faster into the arc chute.

The other end 128 of the arc runner 22 is fixed adjacent, but insulated from, the fixed contact 27. As shown in FIG. 8, The contacts, solenoid and arc runner are arranged such that, immediately after the contacts are separated, the fixed-contact end of the arc between the contacts transfers to the arc runner and, as will be described below, moves down the runner until the arc is extinguished.

Circuit Breaker Operation—Slow Tripping

Tripping operation initiated by this pole is as follows: starting from the position shown in FIG. 2, either finger 52 or 60 is contacted by the relevant trip unit, pivoting the trip link 12 counterclockwise as seen in FIGS. 1–5. When the latching surface 64 has slipped past the latching projection 76 of the latch 42, the latch begins to pivot counterclockwise about the handle link 35 as the crank is accelerated counterclockwise about the mechanism pivot pin 40 as a result of the force applied by the mechanism spring 78 to the crank 38.

Figure 3:
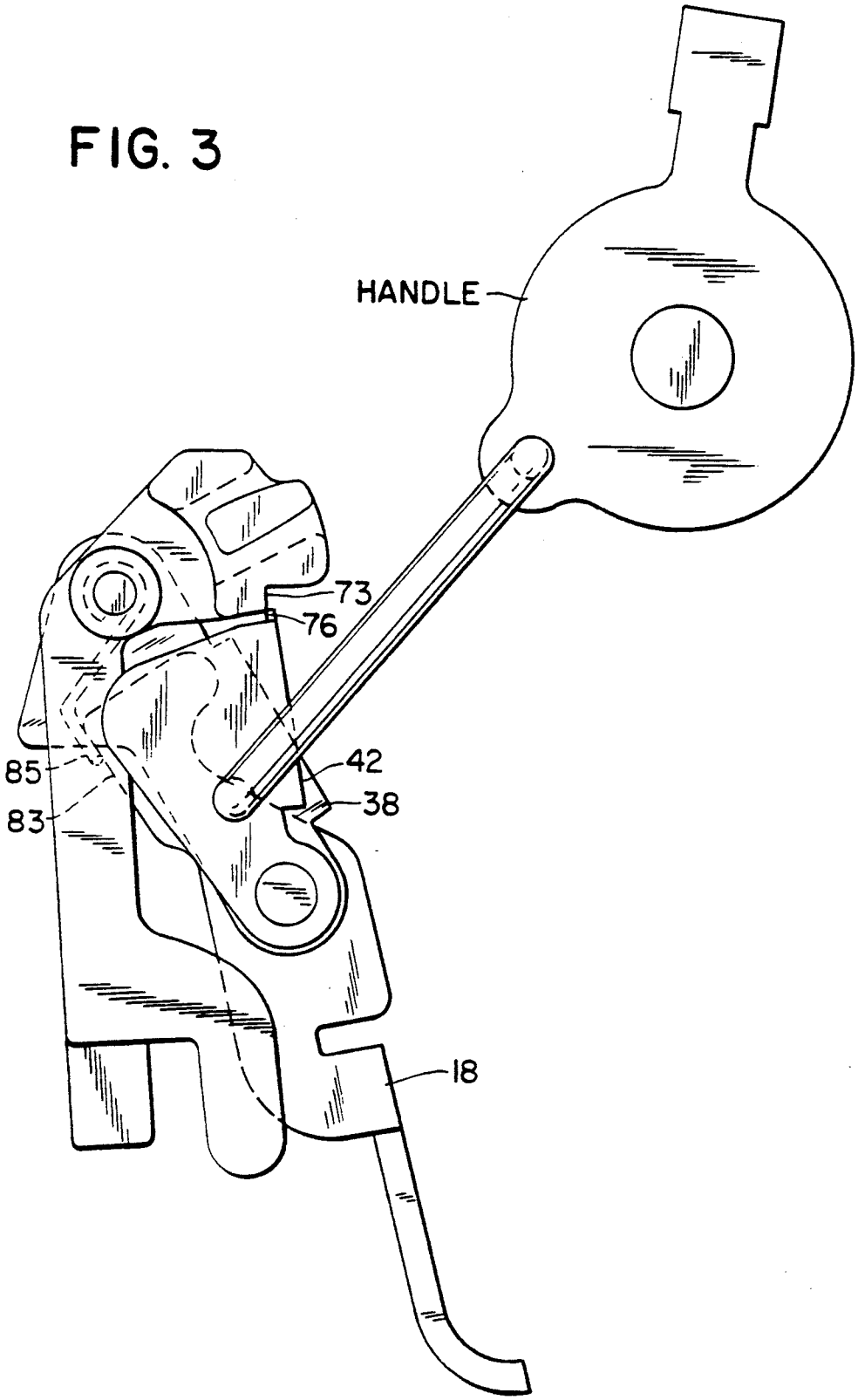
FIG. 3 is a view similar to FIG. 2 but with the mechanism at the trip point.
Figure 4:
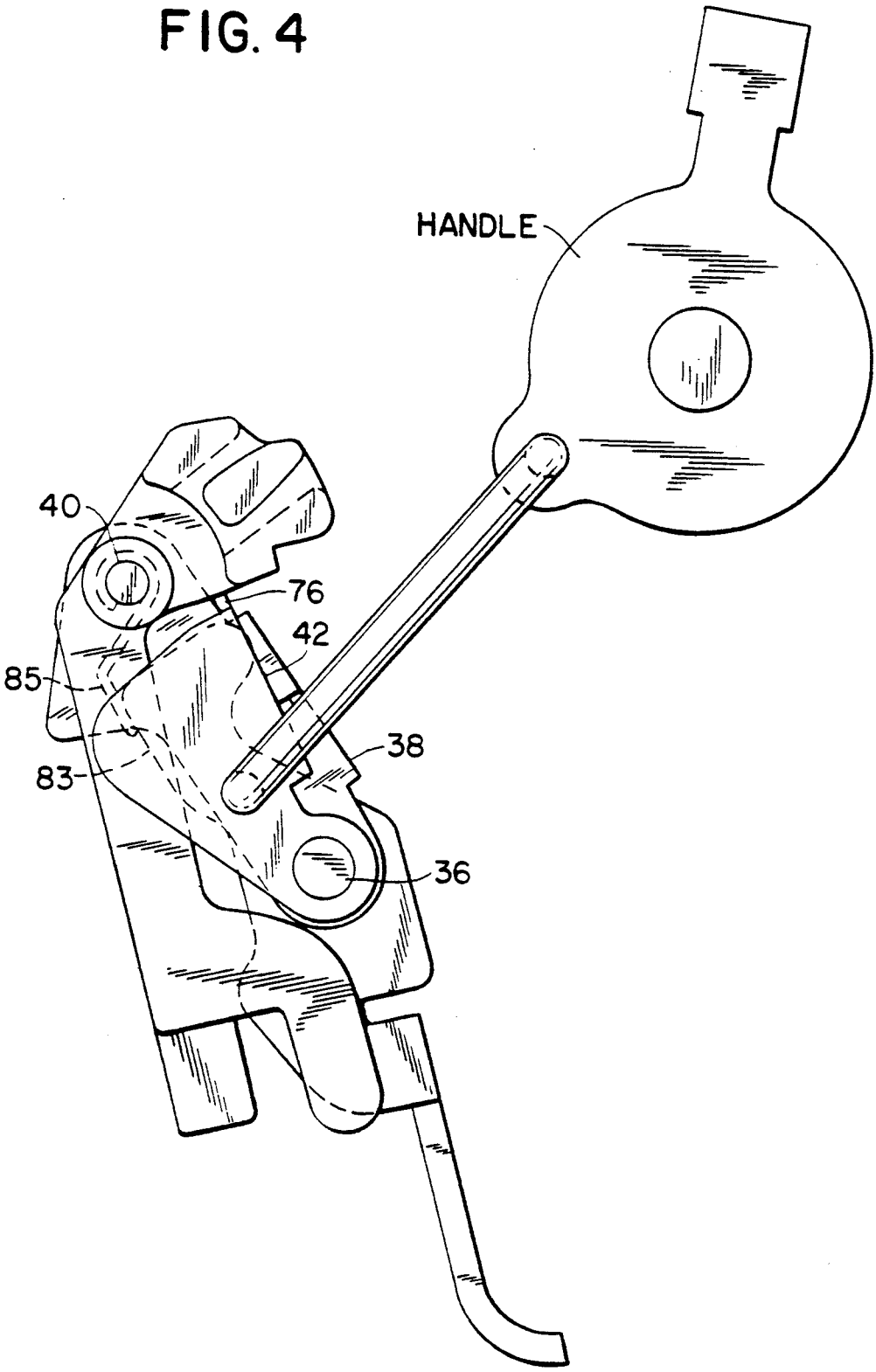
FIG. 4 is a view similar to FIG. 2 but with the mechanism latch at mid-travel.
Figure 5:
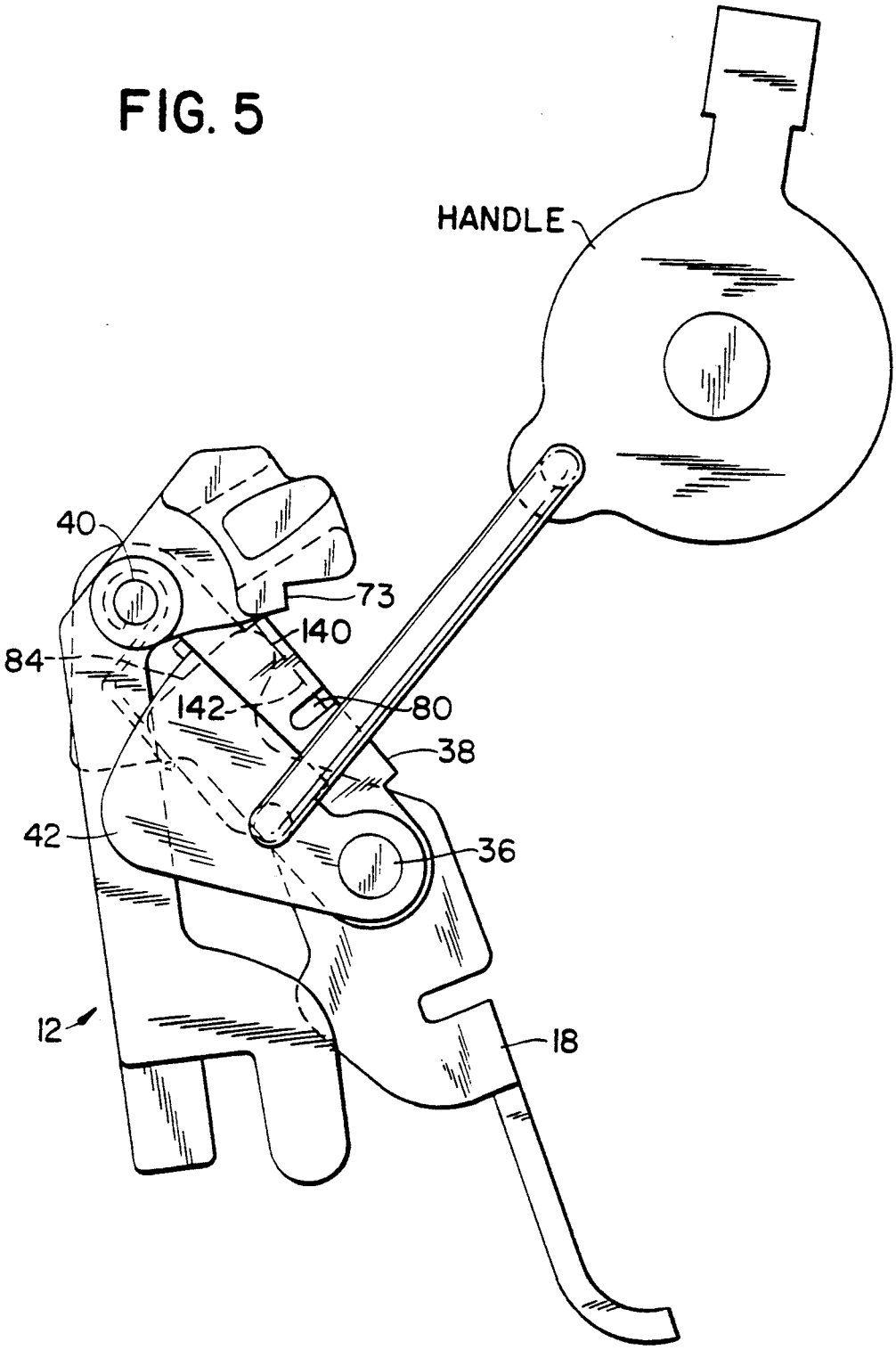
FIG. 5 is a view similar to FIG. 2 but with inter-pole trip completed.

If tripping was caused by movement of the bi-metal strip 14, or rotation of the trip link by an adjoining pole, the contacts are opened rapidly due to the rotation of the crank 38 from the position shown in FIG. 3 to the position shown in FIG. 5. As the crank pin 38 pivots, a nose 140 opposite the side edge 83 of the movable contact arm 18 abuts the inner surface 142 of the base of the "U" of the crank 38, forcing the contact arm then to pivot counterclockwise with the crank, and opening the contact set. At the same time, movement of the end of the contact arm near the mechanism pivot pin 40 causes the end 85 of the contact pressure spring 82 to slide along the side edge 83 to its end, and then to bear against the end edge 84 of the contact arm. This causes the pivoting torque due to the contact pressure spring to reverse, so that this also urges the contacts open.

The release of the latching force on the latch 42 removes the reaction force on the handle link 35. This allows the relatively weak handle spring (not shown) to rotate the handle counterclockwise past dead center of the link-to-handle-pivot line, so that the handle pivots to the open position. This provides a visual indication of the state of the breaker, and also pulls the latch 42 clockwise to the position for resetting. In that position, the end edge 84 of the contact arm 18 has moved so far that the contact pressure spring end 85 slides back from the end edge 84 to the side edge 83. As soon as the tripping force applied to the trip link has been removed, a weak trip link spring (not shown) pivots the trip link back to its normal position, with the latching surface 73 opposite the latching projection 76.

Fast magnetic tripping

If the current through the solenoid 10 suddenly rises to a very high value, for example as a result of a short circuit, the solenoid force produced will be above that which is just sufficient to overcome the solenoid spring 93; and in preferred configurations and ratings of the breaker, far above the minimum for magnetic tripping. This causes the armature 92 of the solenoid to develop a very high saturation force, and to accelerate to speeds exceeding those equivalent to the crank and contact speeds occurring as described above.

Under these circumstances, after the actuating disc 54 has struck and pivoted the trip link sufficiently to unlatch the latch 42, the disc will engage the contact arm 18 between the contact arm pivot pin 36 and the movable contact 28, and will overcome the torque applied by the contact pressure spring 82 and directly pivot the contact arm 18 counterclockwise, opening the contact set 13. This occurs before the crank has accelerated and moved very far under the influence of the mechanism spring 78.

A special advantage of the contact arm, crank and pressure spring arrangement disclosed is that, under fast tripping, the rotation of the contact arm 18 causes the spring end 85 to slip onto the end edge 84 of the arm, reversing the torque so that the movable contact 28 is held away from the fixed contact 27 until the crank 38 and the rest of the operating mechanism have time to reach the final open position, ready for resetting.

Manual Opening

Manual operation of the handle 34, moving the handle to the oeft as seen in FIG. 1, removes the reastion force holding the crank 38 in the closed position. Under the force of the mechanism spring 78, the crank pivots counterclockwise until the nose 140 of the contact arm 18 strikes the inside surface 142 of the crank, and further crank movement opens the contact set 13. The latch 42 will pivot counterclockwise about the point of contact between the latching projection 76 and the latching surface 73 of the trip link 12, leaving the mechanism in condition for closing.

Resetting/Closing

Regardless of the type of tripping or opening cycle, the final position leaves the handle in the open position, fully counterclockwise; the remote end of the contact arm 18 pressing against the corner 104 of the solenoid frame, with the nose 140 at the other end of the arm 18 pressing against the surface 142, and the latching projection 76 adjacent the latching surface 73. Closing movement of the handle 34 causes the handle link 35 to push the latching projection 76 up against the latching surface 73, and then to pivot the latch 42 clockwise about the point of latching engagement, thereby pivoting the latch and contact pivot pin 36, and with it, the crank 38, clockwise about the mechanism pivot pin 40. As the crank pivots, the nose 140 of the contact arm 18 is released from engagement with the inside surface 142 when the movable contact 28 engages the fixed contact 27, and normal contact pressure due to the contact pressure spring 82 is applied.

Solenoid Setting

The solenoid embodiment disclosed herein is just one of many which can utilize this invention aspect. The solenoid 10 is a subassembly of a type suitable for use in other mechanisms besides circuit breakers. The magnetic trip level or current sensitivity (for non-breaker applications) can be easily and accurately set after the device is assembled. One technique which may be used is to apply a current to the coil 16 equal to the desired trip level prior to bending the stop rod 99. Through capturing the actuating disc 54 in a jig, the position of the armature can be controlled to move it to the position where the magnetic pull just equaly the force of the spring 93. While holding the armature 92 in that position, the end 100 of the stop rod is bent over in contact with the end 101 of the bobbin extension 95, establishing the setting through plastic deformation of the stop rod.

Booster Loop/Arc Runner Operation

FIG. 8 shows three stages of current flow through the breaker: contact set 13 closed, contacts opened but arc not yet accelerated toward the arc chute 19, and arc transferred from the fixed contact 27 to the arc runner 22 and partially blown toward the arc chute.

Current flow prior to contact opening is conventional: from the line terminal connection 15, through the bi-metal strip 14 and strap 26 to the fixed contact 27, and from the movable contact 28 through the contact arm 18 and strap 29 to the solenoid coil 16, through the coil to the load terminal connection 17. When the contacts have first opened the only change in path is that, if the current is high enough to sustain a short arc, an arc 150 is established between the contacts 27 and 28. This causes current to flow around three sides of a region 152.

According to well-known principles of electromagnetism, the magnetic field generated around and in the region 152 causes a force urging the arc outward—that is, toward the space 154. As a result, the arc stretches downward as viewed in FIG. 8, and transfers from the fixed contact 27 to the arc runner 22. This causes the current to follow a new path: from the line terminal connection 15 directly to the booster loop end 126, along the booster loop 21 portion to the end 124 adjacent the rear of the arc chute 19, and then back up, in the opposite direction, along the arc runner 22 to the location of instantaneous termination of the arc path 156; and across the space between the runner and the movable contact arm 18.

The curved end of the movable contact arm 18 is selected to cause the arc hot spot to travel from the point of normal conductive contact with the fixed contact 27, moving continuously toward the extreme end until the arc breaks spontaneously (relatively low currents) or is blown into the arc chute 19 and interrupted.

The connections and configuration of the arc runner and booster loop element 20 provide significant performance advantages over prior known circuit breakers: First, as the arc termination travels along the runner, the impedance drops. As a result the force accelerating the arc toward the arc chute increases, and the arc is extinguished faster than with prior art breakers. Second, the overcurrent is quickly diverted from the path through the bi-metal strip 14, so that the calibration of this strip is more consistent.

Alternative Embodiments

It will be clear to those of ordinary skill in the art, that the adjustment feature of the solenoid mechanism disclosed herein could also be utilized in a magnetic device such as a relay, having a clapper rather than a central core armature. Use of the adjustable central stop rod allows adjustment without exchanging springs and without having unbalanced lateral forces which cause irregular friction, and thus inconsistent calibration.

The various elements of the latch and trip mechanism can be utilized independent of each other. For example, the trip link can be used in a single pole breaker, with the axial projections operation a different function. The crank and contact pressure spring arrangement provide important performance advantages independent of the trip link, because the contact pressure spring also aids in opening the contacts and holding them open during fast magnetic tripping.

Thus the scope of the invention includes any embodiments falling within the appended claims.

We claim:

1. A magnetic tripping device for tripping a control element, comprising:

a coil having a coil axis, arranged for producing a magnetic field responsive to passage of a current through the coil, a soft magnetic element adjacent said coil, arranged to concentrate said magnetic field at a region at least adjacent said axis, a magnetic armature, and means for positioning said armature with respect to said coil at least adjacent said region, said means for positioning being arranged to permit movement of said armature in a given direction generally parallel to said axis responsive to production of said magnetic field, and means connected to said armature for tripping said control element responsive to said movement, characterized in that said means for positioning comprises a frame piece fixed with respect to said coil and said soft magnetic element, and an armature stop rod arranged generally coaxially with said axis and having a portion engaging said frame piece, and an end connected to said armature, the length of said stop rod between said portion and said end defining an armature static position, said armature being movable from said static position in said given direction to trip said control element, said portion of said stop rod being a plastically deformable portion bendable into a direction at least oblique to said axis thereby to adjust said length, whereby said static position may be adjusted.

2. A device as claimed in claim 1, wherein said device is a solenoid, said soft magnetic element being a frame extending along the outside of said coil, said coil defining a hollow central zone extending substantially coaxially with said axis to said region adjacent an end of said coil, and said armature being arranged substantially coaxially with said axis, said movement in a given direction being movement into said zone; characterized in that part of said length of the stop rod extending through said central zone.

3. A solenoid tripping device for tripping a control element, comprising:

an insulating bobbin defining a coil axis and a hollow central zone extending substantially coaxially with said axis, a coil wound on said bobbin, arranged for producing a magnetic field responsive to passage of a current through the coil, a soft magnetic frame fixed to said bobbin, extending along the outside of said coil to a region adjacent an end of said coil, arranged to concentrate said magnetic field at said region, a magnetic armature arranged substantially coaxially with said axis, means for positioning said armature with respect to said coil at least adjacent said region, said means for positioning being arranged to permit movement of said armature in a given direction parallel to said axis at least partly into said central zone responsive to production of said magnetic field, and means connected to said armature for tripping said control element responsive to said movement, characterized in that said means for positioning comprises an extension of said bobbin defining a passageway coaxial with said axis and communicating with said central zone, and having a remote end, and an armature stop rod arranged generally coaxially with said axis and passing through said bobbin extension, said rod having a portion engaging said remote end, and an end connected to said armature, the length of said stop rod between said portion and said end defining an armature static position, said armature being movable from said static position in said given direction to trip said control element, said portion of said stop rod being a plastically deformable portion bendable into a direction at least oblique to said axis thereby to adjust said length, whereby said static position may be adjusted.

4. A solenoid as claimed in claim 3, characterized in that said bobbin has an armature bearing portion extending through said frame adjacent said region, said armature bearing portion and said bobbin extension guiding movement of said armature in said given direction, and said means for positioning further comprises a compression spring disposed about a length of said armature and within said central zone, one end of said spring engaging said armature to urge the armature in a direction opposite said given direction, and the other end of said spring bearing against an inner surface of said bobbin adjacent said bobbin extension.

5. A solenoid as claimed in claim 4, characterized in that said armature is a body of revolution, and said means for tripping is a body of revolution extending coaxially from said armature, comprising a disc spaced from said armature, said disc having a tripping surface facing said armature, whereby the center of gravity of said armature and said means for tripping lies substantially on said axis.

* * * * *